United States Patent [19]

Kamifuji et al.

[11] Patent Number: 4,480,618

[45] Date of Patent: Nov. 6, 1984

[54] APPARATUS FOR ENRICHING FUEL UPON ENGINE STARTING OPERATION

[75] Inventors: Hiroshi Kamifuji; Tomoo Ito, both of Katsuta; Haruhiko Kobayashi, Ibaraki; Tomiya Itakura, Katsuta, all of Japan

[73] Assignees: Hitachi, Ltd., Tokyo; Hitachi Automotive Engineering Co., Ltd., Ibaraki, both of Japan

[21] Appl. No.: 436,943

[22] Filed: Oct. 27, 1982

[30] Foreign Application Priority Data

Nov. 2, 1981 [JP] Japan ..... 56-162713[U]

[51] Int. Cl.[3] ..... F02M 7/00

[52] U.S. Cl. ..... 123/438; 123/179 G

[58] Field of Search ..... 123/179 G, 438, 491

[56] References Cited

U.S. PATENT DOCUMENTS 4,346,682 8/1982 Mader ..... 123/179 G 4,364,354 12/1982 Kosuge et al. ..... 123/438

FOREIGN PATENT DOCUMENTS 57-16240 1/1982 Japan ..... 123/179 G

*Primary Examiner*—William A. Cuchlinski, Jr.

*Attorney, Agent, or Firm*—Antonelli, Terry & Wands

[57] ABSTRACT

An apparatus for enriching an air-fuel mixture supplied by a carburetor upon starting operation of an internal combustion engine comprises a fuel quantity increasing passage which is operative independent of main fuel supply system. The passage has an inlet communicated to a fuel supply source and an outlet opened at a location downstream of a throttle valve. The amount of fuel ejected from the outlet of the passage is controlled by a control signal which represents a product of a value variable in dependence on a suction vacuum, the rotational frequency of the engine and a value variable in dependence on the temperature of engine cooling water.

17 Claims, 7 Drawing Figures

APPARATUS FOR ENRICHING FUEL UPON ENGINE STARTING OPERATION

The present invention generally relates to a fuel amount increasing apparatus for enriching an air-fuel mixture produced by a carburetor upon starting operation of an internal combustion engine, and in particular the invention concerns the apparatus for increasing the amount or quantity of fuel in the engine starting operation, wherein a fuel amount increasing passage is provided independent of a main intrinsic fuel supply system, for allowing the fuel quantity tube increased in the engine starting operation.

In the steady operation of the internal combustion engine, the air-fuel ratio of the air-fuel mixture supplied to the engine cylinder from the carburetor is controlled so as to be 14.7. However, since the temperature of engine cooling water is low at the time of the cranking operation as well as the warming-up operation of the engine, it is usually required to reduce the air-fuel ratio to enrich the air-fuel mixture. In that case, it is necessary that the air-fuel ratio be determined in dependence on the warmed-up state of the engine and, more generally, in dependence on the temperature of the engine cooling water, while the air-fuel ratio should be prevented from being varied in dependence on variations in the rotational frequency and the negative suction pressure (i.e. suction vacuum) in the course of time lapse.

The known apparatus for enriching the air-fuel mixture upon the starting operation of the engine may be generally classified into two catagories. According to a first system, an inlet port of a carburetor is constricted by choke valve to increase vacuum at a main nozzle portion for thereby enriching the air-fuel mixture. Belonging to the second category is an arrangement in which a fuel enriching system having an outlet opened at a location downstream of the throttle valve is additionally provided independent of the main intrinsic fuel mixture supply system to increase the amount of fuel in the engine starting operation, as is disclosed in U.S. patent application Ser. No. 110469. When the starting air-fuel ratio (i.e. the air-fuel ratio of the fuel mixture upon the engine starting operation) is to be electronically controlled, the first mentioned system is disadvantageous in that an interlocking mechanism between a motor and a throttle valve becomes complicated. On the other hand, in case of the second mentioned system, the fuel quantity to be increased is determined in dependence on the suction vacuum due to the arrangement in which the outlet of the fuel increasing passage is disposed downstream of the throttle valve, giving rise to a problem that the air-fuel ratio suited for the engine warming-up operation can not be flatly attained except in a predetermined range of the suction vacuum for a particular engine operating state which has been considered in the design.

Further, in the starting fuel increasing system which has the additional fuel passage having the outlet disposed downstream of the throttle valve so that the fuel is drawn out under a negative pressure (i.e. under a vacuum), the fuel amount supplied through the fuel amount increasing system is determined as a function only of the suction vacuum. However, the flow of air in the engine operating state is determined in dependence on both the suction vacuum and the rotational frequency of the engine. Accordingly, it is necessary to control the fuel amount increasing system as a properly coordinated function of the suction vacuum and the rotational frequency of the engine, in order to hold flatly the desired air-fuel ratio determined in dependence on the warmed-up state of the engine.

Accordingly, an object of the present invention is to provide an apparatus for increasing a fuel amount of air-fuel mixture supplied from a carburetor in the engine starting operation, the apparatus being provided independent of a main fuel supply system and capable of performing a flat air-fuel ratio control so that a desired value thereof is maintained in the engine starting operation such as cranking and warming-up operation regardless of variations in the suction vacuum and the rotational frequency of the engine.

In view of the above object, it is proposed according to a feature of the invention that a passage for increasing the fuel amount in the engine starting operation is provided independent of a main fuel supply system operative so as to prepare a mixture having a theoretical air-fuel ratio of 14.7. The passage has an outlet opened downstream of a throttle valve of the main fuel supply system. The amount of fuel supplied through this passage is controlled by a control signal which is derived by correcting a product of a value represented by a function of the suction vacuum and the rotational frequency of the engine by a value represented by a function of the temperature of engine cooling water. According to the invention, a flat control of the air-fuel ratio can be accomplished.

The above and other objects, features and advantages of the present invention will become more apparent by reading the following description of an exemplary embodiment of the invention. The description makes reference to the accompanying drawings which show a starting fuel enriching system according to the invention, only by way of example. In the drawings.

Figure 1:
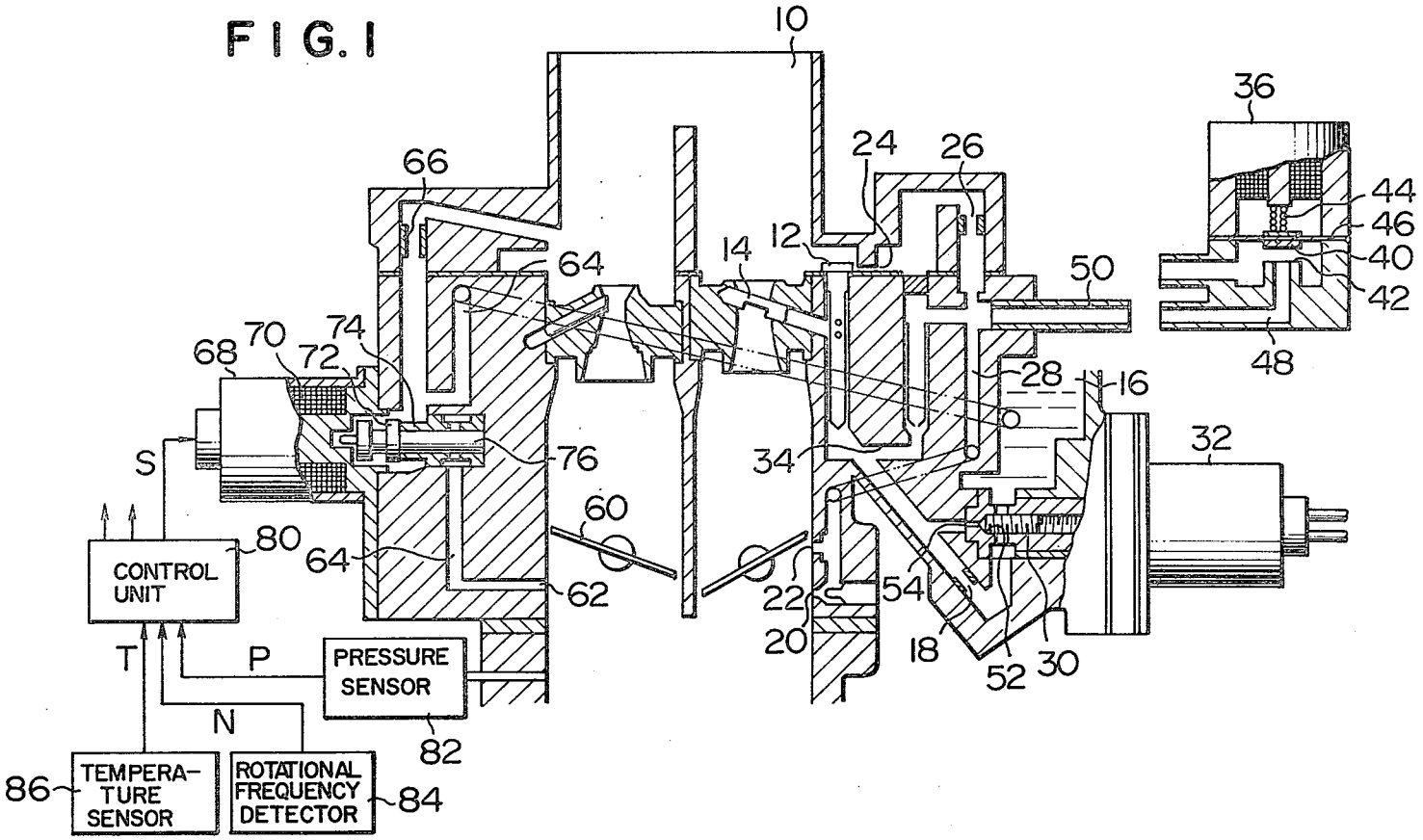
FIG. 1 is a schematic view of the system according to an embodiment of the invention.

Referring to FIG. 1, a high-medium speed fuel system in the primary barrel includes an air passage leading from an inlet 10 of the carburetor to a Venturi through an air jet 12 and a main nozzle 14, and a fuel passage leading from a float chamber 16 to the main nozzle 14 through a main jet 18 and the peripheral gap of the air jet 12. A fuel system similar to that above described is also provided in the secondary barrel. A low speed fuel system includes an air passage leading from the inlet 10 of the carburetor to a vacuum port 20 and an idle port 22 through a passage 24, an air bleed 26 and another passage 28, and a fuel system leading from the float chamber 16 to the passage 28 through the peripheral gap of a valve member 30 of a main solenoid-operated valve 32, the main jet 18 and a slow jet 34. A slow solenoid-operated valve 36 includes an air inlet 38 connected to an air cleaner, and a valve member 40 normally urged to a valve seat 42 by a compression spring 44 and moved away from the valve seat 42 in response to the energization of the solenoid. The valve member 40 is supported by a diaphragm 46. A passage 48 communicates with the passage 28 through a passage 50. The drive signal of rectangular waveform is applied to the solenoid of the slow solenoid-operated valve 36. By varying the duty ratio of this drive signal, the duration in which the valve member 40 is detached from the valve seat 42, that is, the rate of opening of the slow solenoid-operated valve 36 is varied to modify the air-fuel ratio (A/F ratio) of the air-fuel mixture supplied by way of the low speed fuel system. When the solenoid of the main solenoid-operated valve 32 is energized, the valve member 30 is moved away from a valve seat 52 having an axial bore 54 to increase the amount of fuel flowing through this bore 54. The drive signal of rectangular waveform is applied to the solenoid of the main solenoid-operated valve 32. By varying the duty ratio of this drive signal, the duration in which the valve member 30 is urged away from the valve seat 52, that is, the rate of opening of the main solenoid-operated valve 32 is varied to modify the air-fuel ratio of the air-fuel mixture supplied by way of the high-medium fuel system.

The carburetor is additionally provided with a fuel enriching system for increasing the proportion of fuel upon engine starting operation according to the invention independent of the main fuel systems described above. The fuel enriching system includes a starting fuel amount increasing passage 64 which is communicated to the float chamber 16 serving as the fuel supply source and having an opening 62 formed at a location downstream of a throttle valve 60. This passage 64 is also communicated to the inlet port 10 of the carburetor by way of an air bleed 66 at a height higher than the liquid head within the float chamber 16. The air bleed 66 serves not only for improving atomization of fuel upon the starting fuel amount increasing operation but also for preventing overflow of the fuel which may otherwise occur when the fuel amount increasing operation is stopped. The fuel ejected from the outlet port of the fuel amount increasing passage, i.e. a richer jet 62, is controlled by a solenoid valve 68 which is composed of an excitation coil 70 and a valve member 72. When the excitation coil 70 is electrically energized, the valve member 72 is displaced toward the lefthand side as viewed in the figure to be thereby moved away from a stationary member 74. The latter has a flow path 76 of a triangular form in cross-section. The starting fuel amount increasing passage 64 is made effective when the valve member 72 is moved to the left. The air-fuel (A/F) ratio of the air-fuel mixture supplied through this passage 64 is largely in a range of 1 to 2.

Figure 2:
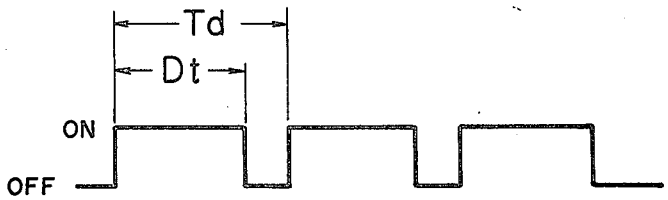
FIG. 2 is a waveform diagram of a control signal utilized in carrying out the invention.

A control unit 80 is supplied at the inputs thereof with a suction vacuum signal P from a pressure sensor 82 for detecting a suction vacuum, a rotational frequency signal N from a rotational frequency detector 84 for detecting the number of rotation of the engine and a temperature signal T from a temperature sensor 86 which is destined to detect the temperature of cooling water of the engine. On the basis of these input signals, the control unit 80 produces a control signal S of rectangular waveform shown in FIG. 2, which signal S is imparted with the duty cycle controlled in dependence on the input quantities mentioned above. The solenoid valve 68 is opened during the on-duty time or interval $D_t$ of the control signal S. In this way, the flow of the enriched fuel-air mixture ejected from the richer nozzle 62 is controlled in dependence on the on-duty time $D_t$ of the control signal S.

Figure 3:
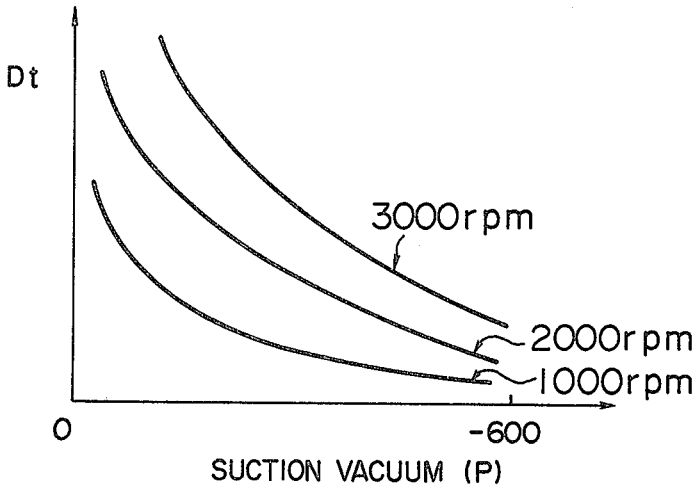
FIG. 3 is a view to illustrate graphically a relationship between the suction vacuum of an engine and the on-duty time of the control signal.
Figure 4:
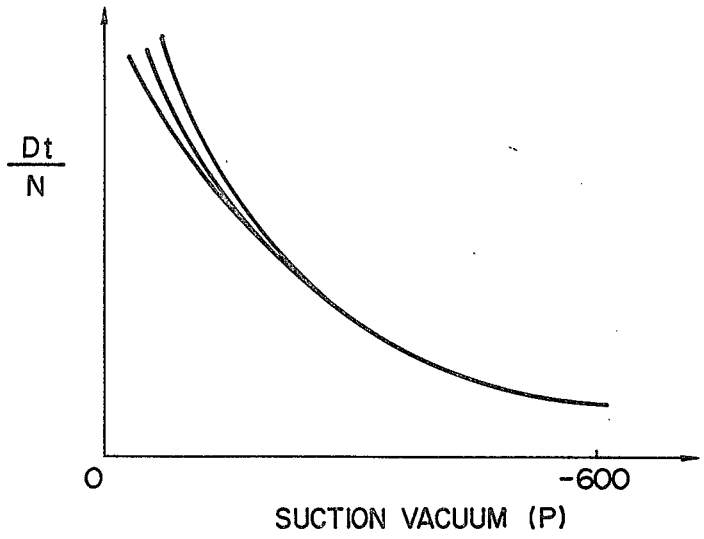
FIG. 4 is a view to illustrate graphically a relationship between the suction vacuum and a quotient of the on-duty time divided by the control signal and the rotational frequency of the engine.

In the fuel enriching system described above, it has been theoretically and experimentally established that the on-duty time $D_t$ should be controlled in dependence on the suction vacuum and the rotational frequency in a manner graphically illustrated in FIG. 3, in order to hold the air-fuel ratio which conforms with the temperature of the cooling water. Further, it has been found that the quotient obtained by dividing the on-duty time $D_t$ by the rotational frequency N varies in dependence on the suction vacuum P substantially in one-to-one correspondence, as is represented by a substantially single curve in FIG. 4. In other words, the quantity $D_t/N$ may be given as a function f(p) of the suction vacuum P. Accordingly, when the engine is to be operated at a predetermined flat air-fuel ratio, the on-duty time or period $D_t$ of the control signal S should be controlled in accordance with the condition given by the following expression:

$$D_t = f(p) \cdot N \quad (1)$$

Figure 5:
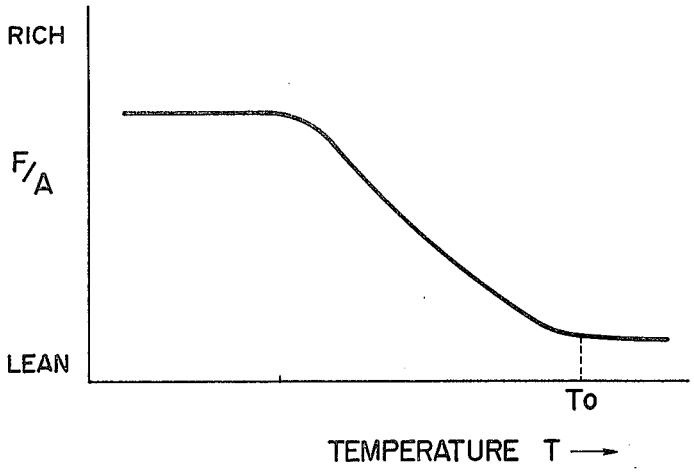
FIG. 5 is a view to illustrate graphically a relationship between the temperature of engine cooling water and reciprocal of the air fuel ratio.

The temperature T of the cooling water varies as a function of time in the engine starting operation. Accordingly, the degree by which the fuel amount is increased has to be controlled so that the air-fuel ratio which conforms with the currently prevailing temperature of the cooling water may be attained. To this end, the on-duty time $D_t$ must be correctively modified by the temperature T of the cooling water. Relationship between the temperature T of the cooling water and the reciprocal of the air-fuel ratio is graphically illustrated in FIG. 5. Accordingly, a correction factor k(T) is first determined on the basis of the temperature T so that the relationship illustrated in FIG. 5 may be obtained, and then the corrected on-duty time $D_t$ may be determined in accordance with the following expression:

$$D_t = f(p) \cdot N \cdot k(T) \quad (2)$$

When the temperature of the engine cooling water exceeds a predetermined value $T_o$, the control is so made that k(T) is equal to zero. At that time, the fuel supply through the fuel richer system is stopped, whereupon the fuel supply is carried out only through the main fuel system which is operated so that the air-fuel ratio may be maintained at 14.7.

Figure 6:
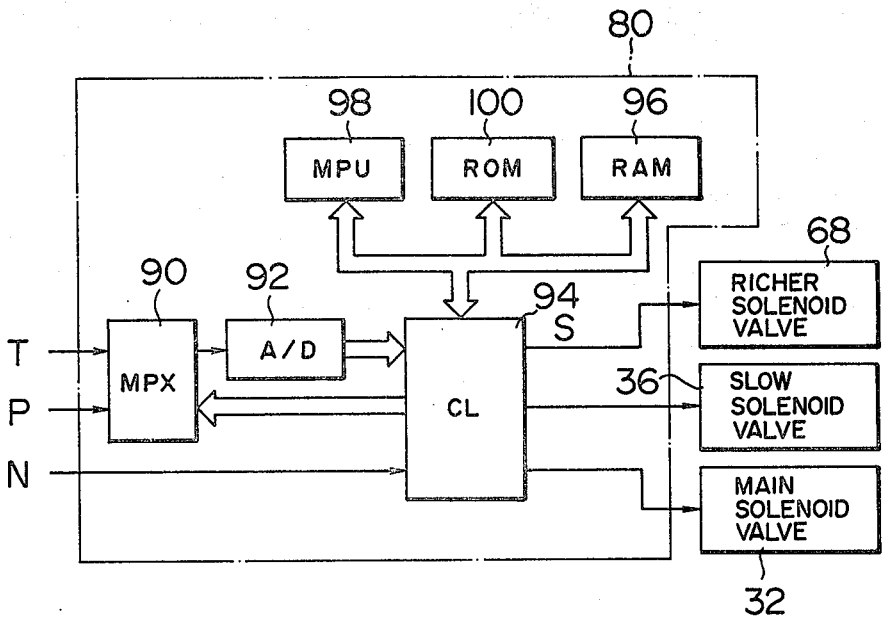
FIG. 6 is a block diagram showing in detail a control unit.

FIG. 6 shows in a block diagram a circuit arrangement of the control unit 80. The temperature T of the engine cooling water and the suction vacuum pressure P are fetched by a multiplexer 90 on a time-division base and undergo A/D (analogue-to-digital) conversion through an A/D converter 92. The resulting digital signals are stored in a RAM (random access memory) 96 by way of a control logic circuit 94. In a similar manner, the rotational frequency N of the engine is also stored in the RAM 96 by way of the control logic 94. A micro-processing unit 98 is provided to arithmetically determine the on-duty time $D_t$ in accordance with a program stored in a ROM (read-only memory) 100. In this connection, it is to be noted that the function f(p) of the suction vacuum pressure P and the correcting factor k(T) are listed in a table in combination with the vacuum pressure P and the temperature T, respectively, which table is stored in the ROM 100. Accordingly, the function f(p) or the correcting factor k(T) corresponding to a given vacuum pressure P or temperature T can be obtained simply by reading out the corresponding value from the stored table. The micro-processing unit 98 calculates the on-duty time $D_t$ of the control signal S in accordance with the expression (2), the result of which is stored in the RAM 96. The control logic 94 produces the control signal S (FIG. 2) having the on-duty period $D_t$ thus calculated. The control signal S is supplied to the solenoid valve 68. The control logic 94 is also adapted to produce the control signals supplied to the solenoid valves 32 and 36. Since such control logic per se has been heretofore known, further description will be unnecessary.

Figure 7:
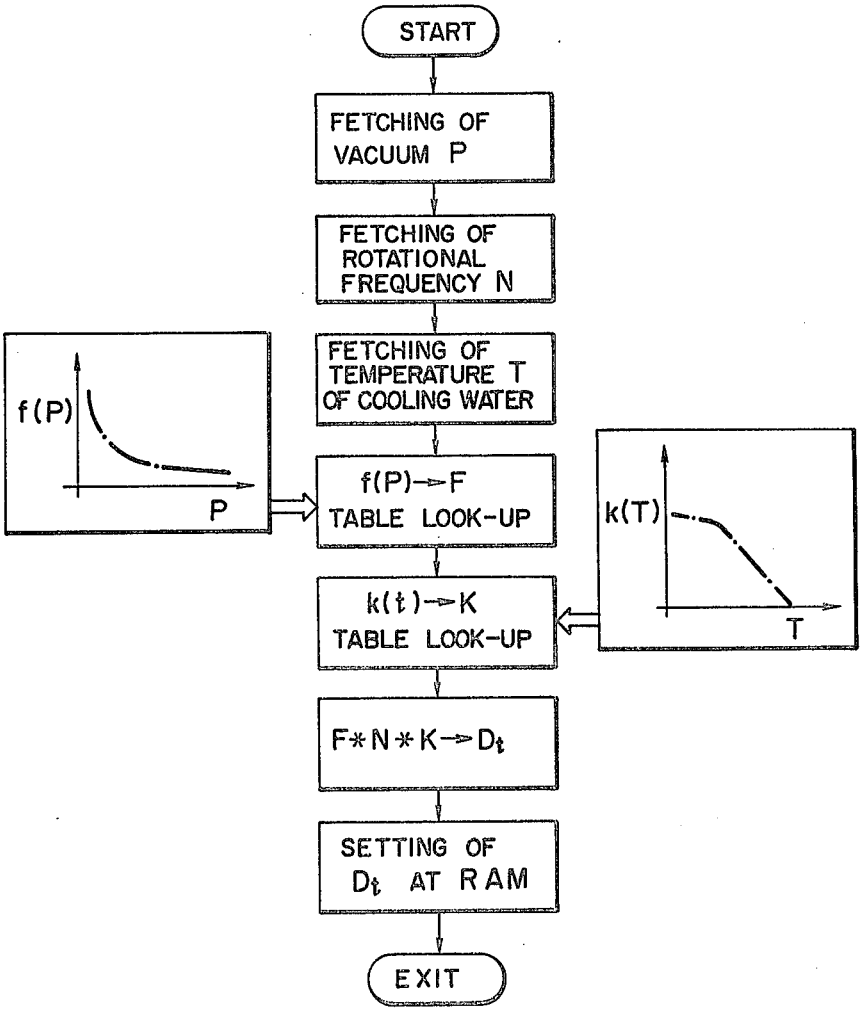
FIG. 7 shows a flow chart to illustrate operation of the apparatus according to the present invention.

A controlling process for carrying out the invention will be described with the aid of a flow chart shown in FIG. 7. At first, the suction vacuum pressure P, the rotational frequency N and the temperature T of the cooling water which vary in dependence on the operating state of the engine are fetched. Next, the function f(p) corresponding to the input suction vacuum P is read out from the table to arithmetically determine the correction factor k(t) and subsequently the on-duty time $D_t$. The on-duty time or period $D_t$ thus determined is stored in the RAM 96. The series of calculations may be effected periodically repeatedly at a predetermined time interval. By setting the calculation interval shorter than the period $T_d$ of the single cycle of the control signal S, the calculation can be effected on the basis of the successively updated data.

As will be appreciated from the foregoing description, the present invention has now proposed an electronic apparatus which is capable of controlling the richer nozzle of the fuel enriching system having an outlet disposed downstream of a throttle valve and operated in the engine starting phase in dependence on the suction vacuum pressure, the rotational frequency and the temperature of the cooling water of the engine by regulating the on-duty time of the control signal applied to the solenoid valve associated with the richer nozzle in conformance with the expression (2), to thereby control flatly the air-fuel ratio of the air-fuel mixture supplied to the engine in all the engine starting operations inclusive of the cranking operation and the warming-up operation.

What is claimed is:

1. An apparatus for enriching an air-fuel mixture supplied by a carburetor to an internal combustion engine in the starting operation thereof, said apparatus being provided independent of main fuel supply system and comprising: a passage having an inlet communicated to a fuel supply source and an outlet opened at a position downstream of a throttle valve; means for controlling flow of the fuel fluid to be ejected from said outlet of said passage; arithmetic operational means for arithmetically determining a product of a rotational frequency of said engine and a value which varies in dependence on a suction vacuum of said engine and correcting said product by a value which varies in dependence on the temperature of engine cooling water, to thereby produce a control signal, and means for driving said flow controlling means in accordance with said control signal produced by said arithmetic operational means.

2. An apparatus for enriching an air-fuel mixture according to claim 1, wherein said control signal is derived as a product of the value which depends on said suction vacuum, the rotational frequency of the engine and the value which depends on the temperature of the engine cooling water.

3. An apparatus for enriching an air-fuel mixture according to claim 2, wherein said arithmetic operational means sets said control signal to zero when the temperature of said cooling water has attained a predetermined value.

4. An apparatus for enriching an air-fuel mixture according to claim 3, wherein said driving means causes said control means to set the fuel fluid flow to zero, when said control is set to zero.

5. An apparatus for enriching an air-fuel mixture according to claim 2, wherein said passage has an opening opened at a position upstream of said throttle valve at a level higher than the liquid head of said fuel source.

6. An apparatus for enriching an air-fuel mixture according to claim 1, wherein said flow control means includes by a solenoid valve.

7. An apparatus for enriching an air-fuel mixture according to claim 6, wherein said drive means is operative to open and close said solenoid valve.

8. An apparatus for enriching an air-fuel mixture according to claim 7, wherein said arithmetic operational means produces the control signal which controls the opening duration of said solenoid valve.

9. An apparatus for enriching an air-fuel mixture according to claim 8, wherein said arithmetic operational means sets said control signal to zero when the temperature of said cooling water has attained a predetermined value.

10. An apparatus for enriching an air-fuel mixture according to claim 9, wherein said driving means causes said control means to set the fuel fluid flow to zero, when said control is set to zero.

11. An apparatus for enriching an air-fuel mixture according to claim 7, wherein said arithmetic operational means sets said control signal to zero when the temperature of said cooling water has attained a predetermined value.

12. An apparatus for enriching an air-fuel mixture according to claim 11, wherein said driving means causes said control means to set the fuel fluid flow to zero, when said control is set to zero.

13. An apparatus for enriching an air-fuel mixture according to claim 6, wherein said arithmetic operational means sets said control signal to zero when the temperature of said cooling water has attained a predetermined value.

14. An apparatus for enriching an air-fuel mixture according to claim 13, wherein said driving means causes said control means to set the fuel fluid flow to zero, when said control is set to zero.

15. An apparatus for enriching an air-fuel mixture according to claim 1, wherein said arithemtic operational means sets said control signal to zero when the temperature of said cooling water has attained a predetermined value.

16. An apparatus for enriching an air-fuel mixture according to claim 15, wherein said driving means causes said control means to set the fuel fluid flow to zero, when said control is set to zero.

17. An apparatus for enriching an air-fuel mixture according to claim 1, wherein said passage has an opening opened at a position upstream of said throttle valve at a level higher than the liquid head of said fuel source.

* * * * *